United States Patent [19]

Woodward

[11] Patent Number: 4,759,504

[45] Date of Patent: Jul. 26, 1988

[54] DUMP CONTROL AND VALVE

[75] Inventor: Michael J. Woodward, Houston, Tex.

[73] Assignee: Weatherford U.S., Inc., Houston, Tex.

[21] Appl. No.: 947,685

[22] Filed: Dec. 30, 1986

[51] Int. Cl.[4] ..... F16K 21/00

[52] U.S. Cl. ..... 239/76; 239/446; 137/110

[58] Field of Search ..... 239/124, 127, 76, 445, 239/447, 444, 446, DIG. 22, 305, 307; 137/110, 115, 512, 512.1

[56] References Cited

U.S. PATENT DOCUMENTS

| | | | |
|---|---|---|---|
| Re. 27,855 | 12/1973 | Norstrud et al. | 239/570 X |
| 3,580,509 | 5/1971 | Goss | 239/302 |
| 3,592,222 | 7/1971 | Goss | 137/467 |
| 3,672,575 | 6/1972 | Hinrichs | 239/447 X |
| 3,690,067 | 9/1972 | Goss et al. | 51/11 |
| 3,723,025 | 3/1973 | Coakley | 417/307 X |
| 3,799,440 | 3/1974 | Goss et al. | 239/120 |
| 3,802,628 | 4/1974 | Goss et al. | 239/302 |
| 3,834,621 | 9/1974 | Pacht et al. | 137/110 X |
| 3,858,358 | 1/1975 | Stachowiak et al. | 51/8 |
| 3,885,739 | 5/1975 | Tuttle | 239/447 X |
| 4,052,008 | 10/1977 | Rogers | 239/DIG. 22 |
| 4,075,928 | 2/1978 | Bitonti | 137/110 X |
| 4,376,443 | 3/1983 | Mondy | 134/168 R |

*Primary Examiner*—Andres Kashnikow
*Assistant Examiner*—Kevin Patrick Weldon
*Attorney, Agent, or Firm*—Vaden, Eickenroht, Thompson & Boulware

[57] ABSTRACT

A multiple high pressure liquid nozzled gun system and flow controller therefor. The flow controller permits the connection of two guns and allows activation or de-activation of one gun without affecting the other gun. The flow controller has multiple internal channels which re-direct liquid flow upon activation or de-activation of a gun. The flow controller has high pressure channels through which liquid under high pressure flows to the gun nozzles and alternate channels through which liquid may flow when the guns are in a trigger-released or "dump" mode permitting liquid to flow through the controller, to the gun, and out of the gun's dump port.

7 Claims, 4 Drawing Sheets

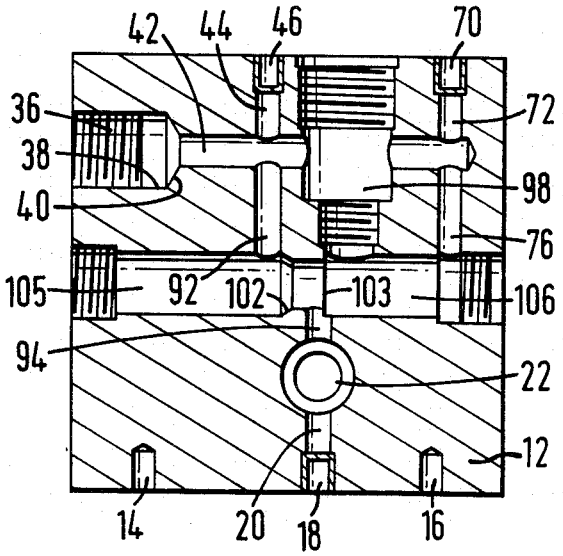
FIG. 5
FIG. 6
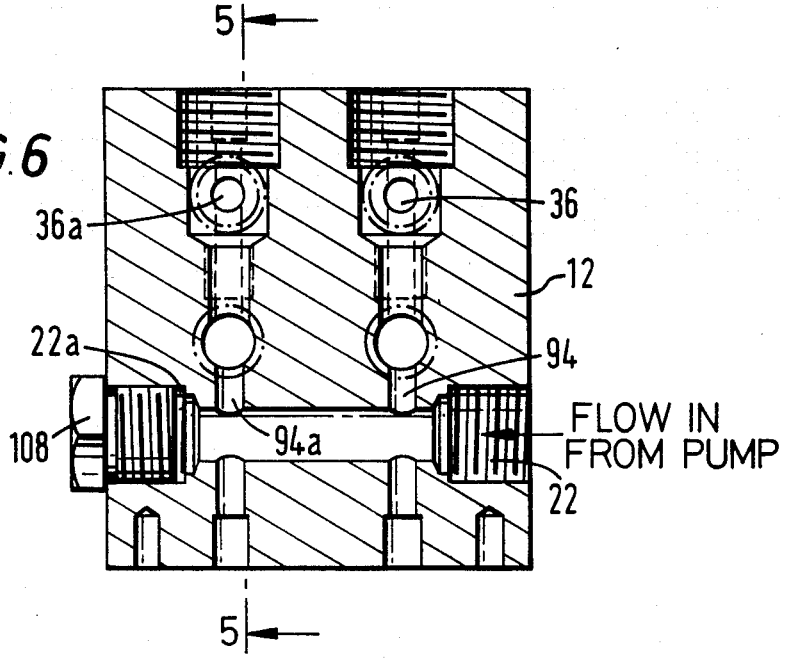

DUMP CONTROL AND VALVE

BACKGROUND OF THE INVENTION

1. Field of the Invention

This invention is directed to a system for the use of multiple liquid blasting guns; to controls for liquid blasting systems; and particularly to dump control valves for water blasting systems.

2. Description of the Prior Art

Water blasting systems are used to produce a high pressure stream of water or water and abrasive particles to clean parts; to clean surfaces; and to blast away scale, paint, rust or contaminants. Such systems have applications in oil refineries, chemical plants, oil field operations, offshore operations and marine industries. These systems utilize pumps which produce pressures up to 50,000 p.s.i.

A high pressure liquid stream is fed to nozzle assemblies or to individually-held guns such as that disclosed in U.S. Pat. Nos. 3,799,440 and 3,802,628. Generally such guns are designed so that upon the pulling of a trigger mechanism, high pressure water flows out of a high pressure nozzle in the gun end. Upon releasing of the trigger, water is directed to a dump port in the gun and flows out of the dump port under very low pressure. Often a plurality of such guns is connected to a single power source. When multiple guns are so powered, often an individual operator encounters numerous occasions when he must shut down his gun and then start it up again. Also with such multiply-connected guns, when the pressure is reduced at a shut-down gun, the output pressure of the power system for the remaining guns may be reduced below an operable level.

Two prior art methods for operating multiple guns from a single power source are illustrated in FIGS. 1 and 2. In the method of FIG. 1, a pump P supplies fluid under pressure to nozzles 1, 2, 3, and 4 via hoses a, b, c, d, e, f, g. All the nozzles are the same size. Control valves I and II are operable to affect the flow from hose d to f and hose e to g, respectively. When both control valves I and II are closed, the pressure at the nozzles 2 and 4 is one-half the pump pressure; e.g. if valve I is closed, then only half the pressure delivered by pump P is available to nozzle 2. When valve I is "closed" flow is possible between hose d and hose f. Valves I and II are referred to as "dump style control valves" which they "dump" relieve the pressure in hoses d, e, f, and g. An "open" valve is one permitting flow; e.g. when valves I and II are open, flow is possible from hoses d and e to the atmosphere. The pressure drop across nozzles 1 and 3 respectively is full pump pressure. Therefore the operators of nozzles 2 and 4 are not affected when either valve I or II is open or closed. With the method of FIG. 1, only half the pump pressure is available at the nozzles. Also, when one operator dumps his gun (i.e. releases the trigger causing water to cease flowing out of the gun's high pressure nozzle and to begin flowing out of the gun's dump port), there is no pressure at the gun's nozzle and valve I opens to the atmosphere. This reduction is pressure causes water flowing through lines c and e to also flow back around the circuit and out of valve I, i.e., this water also seeks the path of least resistance and rather than going out the high pressure nozzle 4 it goes out the valve I. Of course, this means that the operator of gun with nozzle 4 experiences an unexpected pressure loss which could be dangerous if the operator is leaning into the gun to counteract its tendency to push backward or whip around during operation.

FIG. 2 illustrates another prior art system for the use of multiple guns with a single power source. In this method the flow to each gun A and B is governed by pneumatically-powered two-position valves, III and IV; e.g. in a first position of valve III flow is from line a, through line c, and then through line h. Safety valves C and D allow pressure at nozzles A and B to be reduced to atmospheric pressure of valves III and IV fail in their second positions ("Pos. 2"). While in their first positions ("Pos. 1"), valves III and IV allow flow to nozzles E and F such that the pump pressure at P remains the same. This method maintains constant pressure on the pump and allows each gun operator to blast at full pump pressure. However, with this method a supply of compressed air is required to operate the pneumatically powered valves III and IV. Also this method requires signal lines from dump valves C and D to control valves III and IV (in FIG. 2, these lines are lines j and k).

There has long been a need for a relatively inexpensive system which does not require compressed air or signal lines and which is safe and efficient.

SUMMARY OF THE PRESENT INVENTION

The present invention is directed to a system for the use of multiple liquid blasting guns and to a control and valve for such a system. A flow controller according to the present invention has an in-port and dual out-ports for connecting two high pressure nozzled guns. One gun is connected to each out-port. A pump pumps high pressure liquid (e.g. water) into the in-port from which it flows through dual channels to each of the guns. Each channel is so configured that when a gun operator pulls the gun's trigger, a piston within the channel moves to open the channel permitting high pressure liquid to flow to the gun's high pressure nozzle. When the operator releases the gun's trigger (i.e. when he "dumps" the gun), the high pressure fluid "sees" no pressure at the out-port (i.e. the gun will not permit flow to the high pressure nozzle and only permits flow out of the gun's dump port), and springs on one end of the piston push it back to close off the high pressure flow channel; but flow is still permitted through alternate channels of the flow controller, to the out-port of the gun, and to and out of the gun's dump port. A needle valve disposed in the alternate channel is adjusted so that the opening about the needle valve is the equivalent of the restriction presented by the gun's high pressure nozzle. Therefore, if one gun operator dumps his gun, there is no effect on the other gun which is connected to the flow controller. Since the flow to the dumped gun is continued (although flow is to the gun's dump port, not to the gun's high pressure nozzle), pressure is maintained on the other gun. Similarly, when one gun operator pulls his trigger this does not affect the other gun. Flow controllers according to the present invention can be connected in series permitting the simultaneous operation of more than two guns.

It is therefore an object of the present invention to provide a system for use of multiple high pressure liuid guns and to provide a flow controller for controlling the flow of high pressure liquids to such guns.

Another object of the present invention is the provision of a flow controller which permits two guns to be connected to the flow controller and which permits operation of one gun without affecting the operation of the other; particularly it permits one gun to be dumped without affecting the other gun and it permits one gun to be activated without affecting the other gun.

Yet another object of the present invention is the provision of a multi-gun system and of a flow controller which can be operated safely and efficiently.

An additional object of the present invention is the provision of a flow controller which diverts flow internally when a gun connected thereto is dumped so that flow continues through the controller, to the gun, and out of the gun's dump port.

A further object of the present invention is the provision of a system which does not require a signal line from a gun to a dump control valve.

Another object of the present invention is the provision of a system which does not require air-activated dump control valves and which does not require a source of pneumatic power for such valves.

To one of skill in this art who has the benefits of this invention's teachings, other and further objects and inventions will be clear from the following description of presently preferred embodiments, given for the purpose of disclosure, when taken in conjuntion with the accompanying drawings.

BRIEF DESCRIPTION OF THE DRAWINGS

FIG. 5 is a side cross-sectional view of the controller of FIG. 3 with the components of FIG. 4 removed. FIG. 5 is the view along line 5—5 of FIG. 6.

FIG. 6 is a side cross-sectional view of the controller of FIG. 3. FIG. 6 is the view along line 6—6 of FIG. 3 of the body member of the controller. FIG. 6 is a view along line 6*a*—6*a* of FIG. 7.

DESCRIPTION OF THE PREFERRED EMBODIMENT

Figure 1:
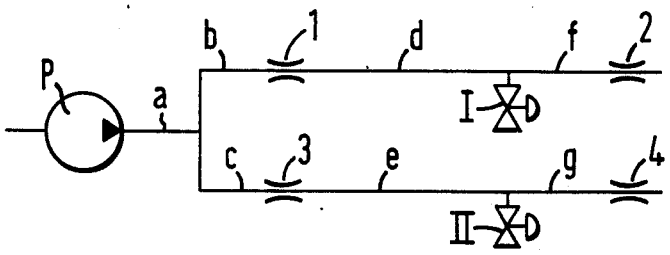
FIG. 1 PRIOR ART
FIG. 1 is a schematic view of a prior art multi-gun system.
Figure 2:
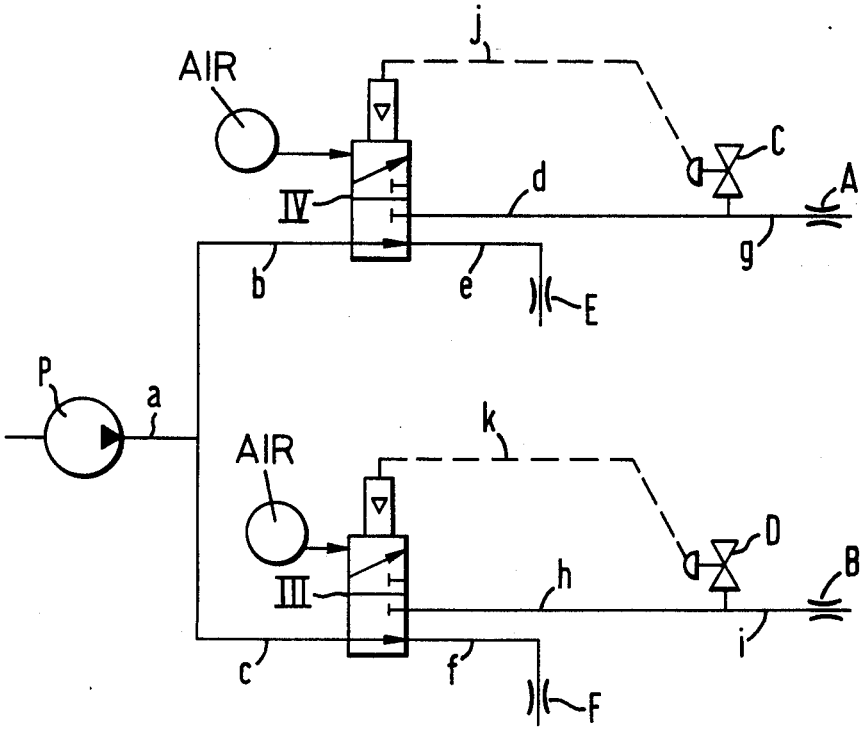
FIG. 2 PRIOR ART
FIG. 2 is a schematic view of a prior art multi-gun system.
Figure 3:
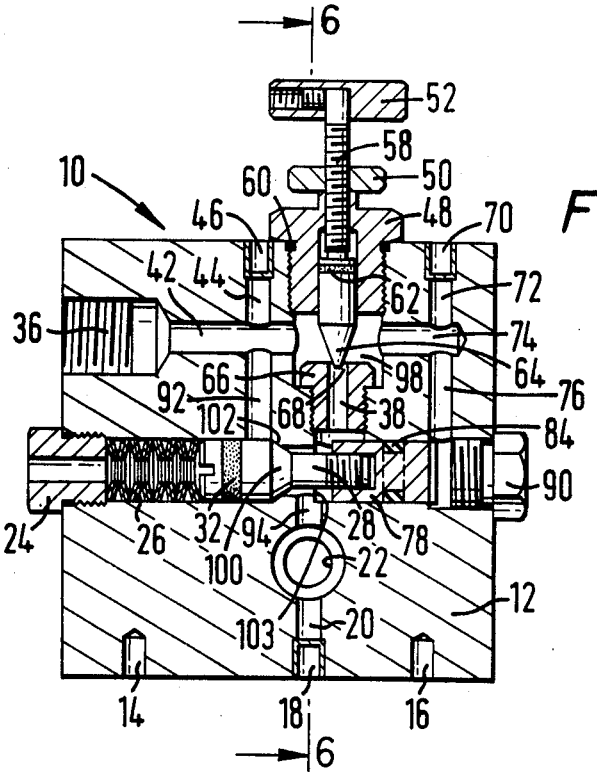
FIG. 3 is a side cross-sectional view of a flow controller according to the present invention.
Figure 4:
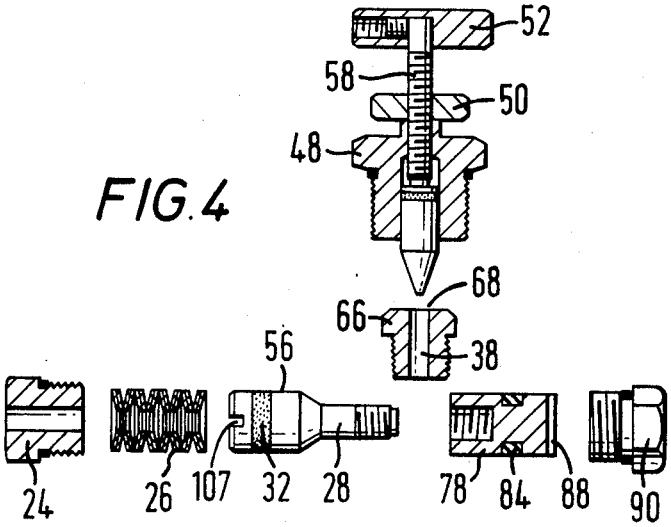
FIG. 4 is a side cross-section view of various components present in the controller of FIG. 3.
Figure 7:
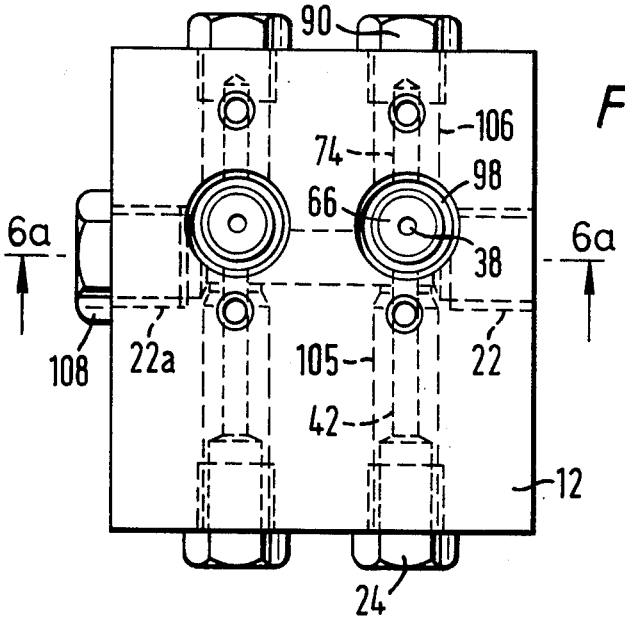
FIG. 7 is a top view of the controller of FIG. 3.
Figure 8:
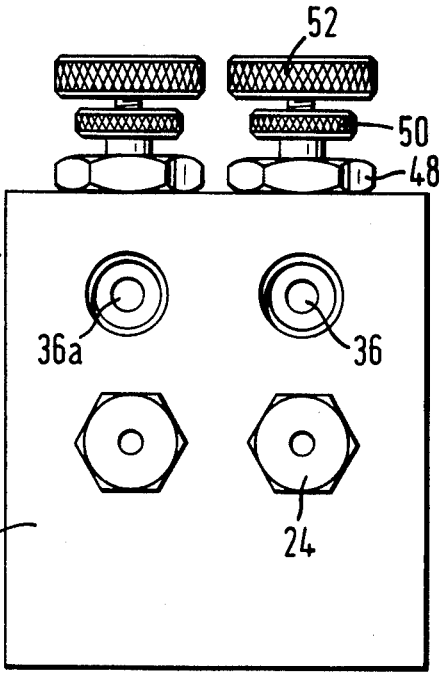
FIG. 8 is a side view of the controller of FIG. 3 showing two out-ports and two series connection ports with plugs in them.

A flow controller 10 according to the present invention is disclosed in FIGS. 1–6. FIG. 3 illustrates the various components and flow channels for one side of the controller 10. As shown in FIG. 6, high pressure water is pumped into an in-port 22 in a body member 12. A plug 108 closes off a port 22*a* which can be used for connecting a plurality of flow controllers 10 in series so that more than two guns may be operated simultaneously from one power source. Channel 94 communicates with in-port 22 and fluid (water) flow through channel 94 to a piston channels 105, 106 in which is movable disposed a piston 28. The piston 28 can move to the right to move its piston seat 100 into sealing contact with the seat member 102 of the body member 12. The piston 28 can move to the left to open the path to a high pressure channel 92 which communicates with the piston channel 105. Upon movement to the left a piston spool 78 will restrict the opening in the channel 106 at the member 103.

The channel 92 communicates with an outlet channel 42 which in turn communicates with an out-port 36. A high pressure nozzled gun (not shown) can be connected with appropriate couplings and hoses to the out-port 36. The channel 42 communicates with a needle valve chamber 98 in which is disposed a needle valve seat 66 having an opening restriction 68 which is at the top of a needle valve seat channel 38 which is in communication with the piston channel 106.

A needle valve retainer 48 is threadedly secured in the body member 12 and is sealed therewith with a seal 60. A needle valve 58 is disposed in and through the needle valve retainer 48 with a needle member 64 disposed so that it may be adjusted to adjust the effective size of the opening restriction 68 of the seat 66. The needle member 64 is sealed in its bore with a seal 62. A handle 52 permits adjustment of the needle valve 58 and it can be locked in position with a needle valve lock 50.

Bores 44, 72, 20 with their respective plugs 46, 70, and 18 are machining holes for various related channels. Mount holes 14 and 16 provide means for mounting the controller 10 to another member.

An alternate channel 74 in communication with the chamber 98 also communicates with an alternate channel 76 which extends downwardly to channel 106 and permits water flowing down channel 76 to contact the spool 78 of the piston 28.

The piston 28 has the spool 78 at one end with a spool seal 84 for sealing the spool 78 within the channel 106. Also, a slot 88 is provided in the spool 78 for receiving a screwdriver for connecting the spool 78 to piston body. A threaded plug 90 closes off the opening through which the spool 78 is inserted into the channel 106. A seal 32 about the piston body 56 seals it in the channel 105 and a slot 107 permits a screwdriver to be used to connect the piston body 56 to the spool 78. Springs 26 urge the piston 28 to the right. A plug 24 closes off the opening through which the piston body 56 is inserted in the channel 105 and it also serves to retain the springs 26 in the channel 105.

Referring to FIG. 3 and FIG. 6, water at high pressure flows into in-port 22 then flows to channels 94 and 94*a*, through intermediate channels and to two guns (not shown) connected to out-port 36 and 36*a*.

When a gun with a high pressure nozzle and with a trigger mechanism whose activation (pulling) permits flow to the high pressure nozzle and whose release permits flow to a gun dump port at low pressure (prohibiting flow to the high pressure nozzle) is connected to the "out" port 36 of the controller 10 and a high pressure liquid pump is connected to the "in" port 22 of the controller 10, a typical cycle of operation is as follows: with the nozzle gun in the dump (trigger released) porition, there is little or no pressure on port 36, therefore the spring 26 pushes the piston 28 and the spool 78 to the right so that the seat 100 of the piston 28 seats against the seat member 102 of the body member 12. This permits fluid to flow from the in port 22, through the channel 94, through the channel 68 in the needle valve seat 66 and into the chamber 98. From the chamber 98 the fluid then flows through the channel 42 and then out the out port 36 and to and through the gun's dump port (it cannot flow to and through the gun's high pressure nozzle). During such flow the needle valve 58 is positioned so that the equivalent diameter of the channel 68 is identical to the restriction of the gun's nozzle.

When the gun's trigger is pulled permitting high pressure water to flow to the gun's nozzle, the pressure "sees" port 36 as blocked and the pressure at the port 36 increases, thus generating force at the right end of the spool 78 at the bottom of the channel 76 (the pressure is communicated to the channel 76 from port 36 via channel 42, channel 98, and channel 74.) This force pushes the spool 78 and the piston 28 up against the springs 26, unseating the piston seat 100 from the seat member 102. This permits flow from the inport 22, through the channel 94, past the seat member 102, through the channel 92, through the channel 42, and then out the out port 36 and to the gun's nozzle (the spool 28 does not abut member 103 of the body member 12 and does not totally close off the path through the channel 68, but since the opening at 103 has a smaller opening then that at the end of channel 92, flow is through channel 92).

To one of skill in this art who has the benefit of this invention's teachings other and further embodiments will be apparent, and certain changes can be made in the embodiments disclosed herein without departing from the spirit and scope of the invention as claimed below.

What is claimed is:

1. An apparatus for a fluid system including a body member, the body member having formed therein a flow controller, the flow controller comprising an inlet channel means, piston channel means, high pressure fluid channel means, outlet channel means, and alternate channel means, the piston channel means having a piston movable mounted therein, both the high pressure channel means and alternate channel means communicating with the piston channel means and the piston movable to close off the high pressure channel means or movable to restrict a first opening through which the alternate channel means communicates with the piston channel means, and valve means disposed in a second opening in the alternate channel means, the valve means adjustable to present the second opening at a desired size to fluid flowing through the alternate channel means.

2. The flow controller of claim 1 wherein the outlet channel means comprises dual outlet channels, each outlet channel having communicting therewith a piston channel means having a piston as claimed in claim 1 and a valve means as claimed in claim 1.

3. the apparatus of claim 2 wherein each valve means is a needle valve having a needle member and a seat, the needle member adjustable with respect to the seat to determine the size of an opening through the seat.

4. The apparatus of claim 2 wherein connections are provided for connecting a gun to each outlet channel, the guns suitable for discharging pressurized fluid flowing through the flow controller, and the pistons in the piston channel means responsive to the activation and de-activation of the guns.

5. The apparatus of claim 2 wherein the pressurized fluid is water.

6. The apparatus of claim 2 wherein a series of openings is provided in communication with the inlet channel means to provide a connection for connecting a plurality of flow controllers in series.

7. A flow controller comprising a body member, the body member having formed herein inlet channel means, piston channel means, high pressure fluid channel means, outlet channel means, and two alternate channel means, the outlet channel means comprising dual outlet channels each having communicating therewith a piston channel means and a valve means, each piston channel means having a piston movably mounted therein both the high pressure channel means and alternate channel means communciating with the piston channel means and the piston movable to close off the high pressure channel means or movable to restrict a first opening through which the alternate channel means communicates with the piston channel means, each valve means disposed in a second opening in the alternate channel means, each valve means comprising a needle valve having a needle member and a seat, the needle member adjustable with respect to the seat to determine the size of an opening through the seat, connection means for connecting a gun to each outlet channel, the guns suitable for discharging pressurized water flowing through the flow controller, and the piston in each of the piston channel means responsive to the activation and de-activation of their corresponding guns, and a series of openings in communication with the inlet channel means to provide a connection for connecting one or more additional flow controllers in series with the flow controller claimed herein.

* * * * *